US011306418B2

(12) United States Patent
Stanhope et al.

(10) Patent No.: US 11,306,418 B2
(45) Date of Patent: Apr. 19, 2022

(54) FLAME RESISTANT FABRIC HAVING HIGH TENACITY LONG STAPLE YARNS

(71) Applicant: Southern Mills, Inc., Union City, GA (US)

(72) Inventors: Michael T. Stanhope, Atlanta, GA (US); Matthew Lucius Colatruglio, Roswell, GA (US)

(73) Assignee: Southern Mills, Inc., Union City, GA (US)

( * ) Notice: Subject to any disclaimer, the term of this patent is extended or adjusted under 35 U.S.C. 154(b) by 720 days.

(21) Appl. No.: 15/316,729

(22) PCT Filed: Jun. 15, 2015

(86) PCT No.: PCT/US2015/035833
§ 371 (c)(1),
(2) Date: Dec. 6, 2016

(87) PCT Pub. No.: WO2015/192131
PCT Pub. Date: Dec. 17, 2015

(65) Prior Publication Data

US 2017/0198419 A1 Jul. 13, 2017

Related U.S. Application Data

(60) Provisional application No. 62/011,624, filed on Jun. 13, 2014.

(51) Int. Cl.
*D03D 15/513* (2021.01)
*D03D 1/00* (2006.01)

(52) U.S. Cl.
CPC ..... *D03D 1/0035* (2013.01); *D03D 15/513* (2021.01); *D10B 2331/021* (2013.01)

(58) Field of Classification Search
CPC . D03D 1/0035; D03D 15/12; D10B 2331/021
See application file for complete search history.

(56) References Cited

U.S. PATENT DOCUMENTS

| | | | | |
|---|---|---|---|---|
| 5,527,597 | A * | 6/1996 | Stanhope | D02G 3/328 442/184 |
| 5,928,971 | A * | 7/1999 | Ellis | A62B 17/003 442/76 |
| 7,393,800 | B2 * | 7/2008 | Corner | D03D 1/0041 442/302 |
| 7,402,538 | B2 | 7/2008 | Bader et al. | |
| 7,820,572 | B2 | 10/2010 | Zhu et al. | |
| 9,259,599 | B2 * | 2/2016 | Stanhope | A62B 17/003 |
| 2004/0092187 | A1 | 5/2004 | Favier et al. | |
| 2006/0177656 | A1 | 8/2006 | Kolmes et al. | |
| 2006/0264136 | A1 | 11/2006 | Chiantese | |
| 2008/0038973 | A1 | 2/2008 | Sasser et al. | |
| 2008/0152906 | A1 * | 6/2008 | Kobayashi | D03D 15/00 428/367 |
| 2009/0053954 | A1 | 2/2009 | Zhu et al. | |
| 2012/0034835 | A1 | 2/2012 | Hess et al. | |
| 2012/0180449 | A1 * | 7/2012 | Portales Reig | D02G 3/441 57/210 |
| 2013/0210306 | A1 | 8/2013 | Cobb et al. | |
| 2014/0360619 | A1 | 12/2014 | Underwood et al. | |
| 2015/0121612 | A1 | 5/2015 | Favier et al. | |
| 2015/0297919 | A1 * | 10/2015 | Stanhope | D03D 41/00 2/458 |
| 2017/0130372 | A1 | 5/2017 | Underwood et al. | |

FOREIGN PATENT DOCUMENTS

| | | | |
|---|---|---|---|
| CN | 1829831 | | 9/2006 |
| CN | 1829833 | A | 9/2006 |
| CN | 1869301 | | 11/2006 |
| CN | 103622186 | A | 3/2014 |
| JP | 04361636 | | 12/1992 |
| JP | 2000144526 | | 5/2000 |
| JP | 2007500803 | | 1/2007 |
| JP | 2007530819 | | 11/2007 |
| JP | 2008530384 | | 8/2008 |
| WO | 2005/019512 | A2 | 3/2005 |
| WO | 2013-078287 | A1 | 5/2013 |

OTHER PUBLICATIONS

International Preliminary Reporton Patentability, PCT Application No. PCT/US2015/035833, dated Dec. 22, 2016.
International Search Report and Written Opinion, PCT Application No. PCT/US2015/035833, dated Aug. 27, 2015.
Office Action, Chinese Patent Application No. 201580031715.6, dated Nov. 15, 2017.
Chinese Application No. 201580031715.6, Office Action, dated Aug. 9, 2018, 14 pages.
European Patent Application No. 15806706.6, Extended European Search Report, dated Feb. 13, 2018, 5 pages.
Chinese Application No. 201580031715.6, Office Action, dated Jan. 24, 2019, 19 pages.
Australian Patent Application No. 2015274297 , First Examination Report, dated Apr. 24, 2019, 3 pages.
Australian Patent Application No. 2015274297 , Second Examination Report, dated Aug. 19, 2019, 3 pages.
(Continued)

*Primary Examiner* — Robert H Muromoto, Jr.
(74) *Attorney, Agent, or Firm* — Kilpatrick Townsend & Stockton LLP

(57) ABSTRACT

Flame resistant fabrics that have incorporated into them high tenacity long staple yarns formed of long staple fibers. Such high tenacity long staple yarns are less expensive than continuous filament yarns and increase the strength of fabrics that incorporate them as compared to fabrics formed of only spun yarns formed of short staple fibers.

20 Claims, No Drawings

(56) References Cited

OTHER PUBLICATIONS

Chinese Patent Application No. 201580031715.6 , Office Action, dated Jul. 1, 2019, 11 pages.
Japanese Patent Application No. 2016-572745 , Office Action, dated Jul. 23, 2019, 10 pages.

* cited by examiner

FLAME RESISTANT FABRIC HAVING HIGH TENACITY LONG STAPLE YARNS

CROSS-REFERENCE TO RELATED APPLICATIONS

This is a U.S. national phase application under 35 U.S.C. § 371 of International Patent Application No. PCT/US2015/035833, titled "Flame Resistant Fabric Having High Tenacity Long Staple Yarns" and filed Jun. 15, 2015, which claims priority to U.S. Provisional Patent Application No. 62/011,624, titled "Flame Resistant Fabric Having Stretch Broken Yarns" and filed Jun. 13, 2014, the entirety of both which are incorporated herein by reference.

FIELD

The present disclosure relates generally to flame resistant fabrics, and more particularly to flame resistant fabrics including long staple fibers.

BACKGROUND

Incorporating continuous filament yarns into fabrics will typically increase the strength of those fabrics. However, continuous filament yarns tend to be expensive. Thus, there is a need for fabrics formed with an alternative yarn that is less expensive but that still enhances the strength of the fabric.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention relate to flame resistant fabrics that have incorporated into them high tenacity long staple yarns. Such yarns are less expensive than continuous filament yarns but increase the strength of the fabric.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

As used herein, a "continuous filament yarn" refers to a fiber of an indefinite or extreme length, such as found naturally within silk.

As used herein, a "long staple yarn" refers to a yarn formed from long staple fibers. Long staple fibers are defined as fibers having a staple length longer than 2 inches. As one of skill in the art will understand, long staple fibers may be formed using a variety of processes, including, but not limited to, a stretch break process, cutting continuous fiber into long staple length, or harvesting long staple fibers by shearing animals (e.g., to obtain long staple wool fibers). During the stretch break process, for example, the long staple fibers are formed by breaking filament yarn to form non-continuous long staple fibers having lengths of approximately 2 to 40 inches. The long staple fibers resulting from these and other processes may be of uniform length or non-uniform length. Moreover, the long staple fibers used to form a long staple yarn may be of the same or different lengths.

Long staple fibers are made into long staple yarns using systems and processes designed for use with long staple fibers (as opposed to cotton systems), such as the stretch break, woolen, and worsted systems and processes. The stretch break process and exemplary methods for forming stretch broken yarns (a type of long staple yarn a defined herein) from long staple fibers are described in the "Continuous Filament to Staple Length Conversion" document, a copy of which was appended to the priority provisional application and is incorporated herein in its entirety.

"Spun yarns" are yarns formed of short staple fibers, such as fibers having lengths of 2 inches or less.

Unlike filament yarn, which is measured in units of denier, long staple yarns (such as stretch broken yarns) are measured by yarn count (e.g., metric count), similar to spun yarns.

Embodiments of the invention relate to a flame resistant fabric that includes high tenacity ("HT") long staple yarns, such as but not limited to stretch broken yarns. The HT long staple yarns are inserted into the fabric such that they increase the strength of the fabric as compared to a fabric without such yarns. Further, because the HT long staple yarns are stronger than the other yarns in the fabric in which they are inserted, the overall weight of the fabric may be decreased while maintaining the strength of the fabric. In some embodiments, fabrics according to the invention have a weight of approximately 3-8.5 ounces per square yard ("osy"), and have similar or greater strength as compared to fabrics without the HT long staple yarns that weigh at least about 10% more.

The HT long staple yarns may be located in the fabric in any desirable location. In some exemplary embodiments, the HT long staple yarns are woven or knitted into the fabric in a grid pattern or a stripe (e.g., horizontal or vertical) pattern. Any desirable weave (e.g., plain, twill) or knit (e.g., single, double, plain, interlock) pattern may be used. Further, the HT long staple yarns may be located in either the warp or filling direction in the fabric or, when incorporated into the fabric in, e.g., a grid pattern, in both the warp and filling directions.

The HT long staple yarns may also be combined, coupled, or covered (i.e., plied, ply twist, wrapped, coresheath, coverspun, etc.) with one or more other flame resistant or non-flame resistant spun yarns (or staple fibers), filament yarns, and long staple yarns. For example, in one embodiment, the HT long staple yarns are plied with one of a spun, filament, or other long staple yarn.

The remainder of the yarns in the fabric can include any desired spun yarns, which may be, but do not have to be, combined, coupled, or covered with other yarns (spun, filament, long staple) as described above.

The HT long staple yarns may be located in the fabric relative to the spun yarns in any desired ratio. The yarn ratio may be calculated in two different ways—either by counting the individual yarns or by counting the ends. For example, when considering a plied yarn (e.g., a HT long staple yarn plied with a spun yarn), each yarn can be considered individually for purposes of determining the HT long staple yarn to spun yarn ratio or the two plied yarns can be considered as a single end. For example, consider a fabric woven in a pattern with the following yarn repeat:

Two yarns, each formed by plying two spun yarns; and

One yarn formed by plying a HT long staple yarn with one spun yarn.

The ratio of HT long staple yarns to spun yarns for such a fabric is 1:5 if you count each individual yarn or 1:2 if you count each yarn end.

Using either yarn ratio calculation method, the yarn ratio of HT long staple yarns to spun yarns can be from about 40:1 to about 1:40, or from about 30:1 to about 1:30, or from about 25:1 to about 1:25, or from about 20:1 to about 1:20, or from about 15:1 to about 1:15, or from about 10:1 to about 1:10, or 9:1, or 8:1, or 7:1, or 6:1, or 5:1, or 4:1, or 3:1, or 2:1, or 1:1, or 1:2, or 1:3, or 1:4, or 1:5, or 1:6, or 1:7, or 1:8, or 1:9, or even from about 2:3 to about 1:3. In certain embodiments, one HT long staple yarn will be inserted in the fabric relative to the spun yarns in a ratio of about one HT long staple yarn for every 2-5 spun yarns.

Set forth below are suitable materials from which to form the HT long staple yarns and the spun yarns used in embodiments of the fabric. Note that the fibers that form the HT long staple yarns and the spun yarns may be flame resistant, but all need not be. Rather, any combination of flame resistant/non-flame resistant materials can be used as long as the overall fabric is flame resistant and/or satisfies the desired standards for flame resistant fabrics. More specifically, in some embodiments the fabric is a protective fabric suitable for use in fire service apparel and thus preferably complies with the heat, flame, and fire performance and safety standards (e.g. thermal shrinkage, vertical flammability, and char length requirements), as set forth in, for example, National Fire Protection Association (NFPA) 1971, 1991 Edition.

Exemplary suitable FR and non-FR materials that can be used to form the long staple fibers that subsequently form the HT long staple yarns for the fabrics of the present invention include, but are not limited to, high tenacity materials such as para-aramid, meta-aramid, polybenzoxazole (PBO), modacrylic, poly{2,6-diimidazo[4,5-b:40; 50-e]-pyridinylene-1,4(2,5-dihydroxy)phenylene} ("PIPD"), ultra-high molecular weight ("UHMW") polyethylene, UHMW polypropylene, polyvinyl alcohol, polyacrylonitrile, liquid crystal polymer, glass, nylon (and FR nylon), carbon, silk, polyamide, polyester, and natural and synthetic cellulosics (e.g., cotton, rayon, acetate, triacetate, and lyocell fibers, as well as their flame resistant counterparts FR cotton, FR rayon, FR acetate, FR triacetate, and FR lyocell).

These materials may be provided in fiber and/or filament form for use in forming the long staple fibers used to form the HT long staple yarns. Examples of para-aramid materials include KEVLAR™ (available from DuPont), TECHNORA™ (available from Teijin Twaron BV of Arnheim, Netherlands), and TWARON™ (also available from Teijin Twaron BV). Examples of meta-aramid materials include NOMEX™ (available from DuPont), CONEX™ (available from Teijin), and Kermel (available from Kermel). An example of a suitable modacrylic material is PROTEX™ available from Kaneka Corporation of Osaka, Japan. An example of a PIPD material includes M5 (Dupont). Examples of UHMW polyethylene materials include Dyneema and Spectra. An example of a liquid crystal polymer material is VECTRAN™ (available from Kuraray). Examples of suitable rayon materials are Viscose™ and Modal™ by Lenzing, available from Lenzing Fibers Corporation. An example of an FR rayon material is Lenzing FR™, also available from Lenzing Fibers Corporation. Examples of lyocell material include TENCEL G100™ and TENCEL A100™, both available from Lenzing Fibers Corporation.

In some embodiments, all of the HT long staple yarns in the fabric may be formed with 100% of a same type of material such that all of the HT long staple yarns in the fabric are the same. Alternatively, HT long staple yarns formed of different materials may be used in the fabric. Moreover, each HT long staple yarn may be formed from the same or different types of materials. For example, a HT long staple yarn may be formed of mixed long staple fibers (e.g., para-aramid and UHMW polyethylene).

Exemplary fibers for use in the spun yarns include, but are not limited to, para-aramid fibers, meta-aramid fibers, polybenzoxazole ("PBO") fibers, polybenzimidazole ("PBI") fibers, modacrylic fibers, poly{2,6-diimidazo[4,5-b:40; 50-e]-pyridinylene-1,4(2,5-dihydroxy)phenylene} ("PIPD") fibers, natural and synthetic cellulosic fibers (e.g., cotton, rayon, acetate, triacetate, and lyocell fibers, as well as their flame resistant counterparts FR cotton, FR rayon, FR acetate, FR triacetate, and FR lyocell), nylon and/or FR nylon fibers, TANLONT™ (available from Shanghai Tanlon Fiber Company), wool fibers, melamine fibers (such as BASOFIL™, available from Basofil Fibers), polyester fibers, polyvinyl alcohol fibers, polyetherimide fibers, polyethersulfone fibers, polyamide fibers, UHMW polyethylene fibers, UHMW polypropylene fibers, polyacrylonitrile fibers, liquid crystal fibers, glass fibers, carbon fibers, silk fibers, and blends thereof.

Each spun yarn may be formed of a single fiber type or different fiber types may be blended to form the spun yarn. Moreover, all of the spun yarns provided in the fabric may be the same or, alternatively, spun yarns formed of different fibers may be used in the same fabric. In some embodiments, the fibers selected and/or blended to form the spun yarns enhance a property of the fabric, such as, but not limited to, the comfort, durability, and/or dyeability/printability of the fabric.

Flame resistant fabrics formed with HT long staple yarns according to embodiments described herein will generally have a lower tenacity than an equivalent fabric having filament yarns in place of the HT long staple yarns, but will have a higher tenacity than an equivalent fabric having spun yarns in place of the HT long staple yarns. This is because, unlike filament yarns, HT long staple yarns are not continuous and would not be expected to have comparable strength as filament yarns having the same weight and formed from the same material. The long staple fibers in HT long staple yarns are longer, however, than the short staple fibers in traditional spun yarns, and thus the HT long staple yarns are stronger than equivalent spun yarns.

The NFPA provides minimum guidelines as to the strength a fabric must have in order to be used in the construction of firefighter garments. NFPA 1971 provides tensile and tear strength specifications for suitable fire protective fabrics and garments. The strength of a fabric formed in accordance with embodiments of the present invention ("Inventive Fabric") was compared against a Control Fabric. The fabrics were as follows:

Inventive Fabric:

6.7 osy twill weave fabric with HT stretch broken yarns and spun yarns woven in both the warp and filling directions;

HT stretch broken yarns formed of 100% para-aramid long staple fibers;

spun yarns are a 60/40 blend of para-aramid (Kevlar®) and meta-aramid (Nomex®) staple fibers;

two HT stretch broken yarns are plied together to form an end;

two spun yarns are plied together to form an end; and the fabric is woven in each of the warp and filling directions in a pattern with two ends of the two-ply spun yarns followed by one end of the two-ply HT stretch broken yarns.

Control Fabric:

7.5 osy 3-end rip stop fabric formed of 100% spun yarns (all two ply); and each spun yarn is a 60/40 blend of para-aramid (Kevlar®) and meta-aramid (Nomex®) staple fibers.

The performance results* are set forth in Table I:

TABLE I

| Test Method | Test Name | Inventive Fabric | Control Fabric |
|---|---|---|---|
| ASTM D 5587 | Trap Tear | 47 lbs. (warp) × 46 lbs. (fill) | 45 lbs. (warp) × 31 lbs. (fill) |
| ASTM D 5034 | Tensile Strength | 388 lbs. (warp) × 398 lbs. (fill) | 316 lbs. (warp) × 302 lbs. (fill) |

*all tests were conducted before laundering

Thus, the Inventive Fabric is significantly stronger than the Control Fabric, while weighing over 10% less than the Control Fabric.

Other fabric constructions are, of course, possible and within the scope of the present invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

The invention claimed is:

1. A flame resistant fabric comprising:

(a) a plurality of first yarns comprising a fiber blend comprising a plurality of first fibers comprising a first type of material and a plurality of second fibers comprising a second type of material different from the first type of material, wherein the plurality of first fibers comprise long staple fibers; and (b) a plurality of second yarns comprising inherently flame resistant fibers comprising inherently flame resistant material, wherein at least one of the first type of material and the second type of material is different from the inherently flame resistant material of at least some of the inherently flame resistant fibers of the second yarns such that the first yarns and second yarns are different and wherein the fabric satisfies one or more performance standards set forth in NFPA 1971 (1991).

2. The flame resistant fabric of claim 1, wherein the fabric comprises a warp direction and a fill direction and wherein the plurality of first yarns is provided in only one of the warp direction or the fill direction.

3. The flame resistant fabric of claim 1, wherein the fabric comprises a warp direction and a fill direction and wherein the plurality of first yarns is provided in both the warp and fill directions.

4. The flame resistant fabric of claim 1, wherein at least some of the plurality of first yarns are plied with another yarn.

5. The flame resistant fabric of claim 1, wherein the fabric comprises 1-5 individual second yarns for every one individual first yarn.

6. The flame resistant fabric of claim 1, wherein the first type of material comprises flame resistant material.

7. The fabric of claim 6, wherein the first type of material comprises an aramid material.

8. The flame resistant fabric of claim 1, wherein the second type of material comprises non-flame resistant material.

9. The flame resistant fabric of claim 1, wherein at least some of the plurality of first yarns comprise stretch broken yarns.

10. The flame resistant fabric of claim 1, wherein the fabric is a woven or knitted fabric.

11. A woven flame resistant fabric having a warp direction and a fill direction, the fabric comprising:

(a) a plurality of long staple yarns provided in the warp and fill directions, wherein at least some of the plurality of long staple yarns comprise 100% aramid long staple fibers;

(b) a plurality of spun yarns interwoven with the plurality of long staple yarns in the warp and fill directions, wherein at least some of the plurality of spun yarns comprise 100% aramid short staple fibers, wherein at least one of the plurality of long staple yarns is plied with another of the plurality of long staple yarns and wherein at least one of the plurality of spun yarns is plied with another of the plurality of spun yarns.

12. The woven flame resistant fabric of claim 11, wherein at least one individual long staple yarn is provided in the fabric for every one to five individual spun yarns in the fabric.

13. The flame resistant fabric of claim 1, wherein the second fibers comprise long staple fibers.

14. The flame resistant fabric of claim 1, wherein the second type of material comprises flame resistant material.

15. The flame resistant fabric of claim 14, wherein the second type of material comprises inherently flame resistant material.

16. The flame resistant fabric of claim 6, wherein the second fibers comprise long staple fibers and wherein the second type of material comprises flame resistant material.

17. The flame resistant fabric of claim 1, wherein at least some of the inherently flame resistant fibers of the second yarns comprise short staple fibers.

18. The flame resistant fabric of claim 1, wherein at least some of the second yarns comprise filament yarns.

19. A flame resistant fabric comprising:

(a) a plurality of first yarns comprising a fiber blend comprising a plurality of first fibers and second fibers, wherein the plurality of first fibers are long staple fibers and comprise aramid material and wherein the second fibers comprise a material different from the aramid material of the first fibers; and (b) a plurality of second yarns comprising a fiber blend comprising a plurality of third fibers, wherein the third fibers comprise inherently flame resistant short staple fibers, wherein the fiber blend of the plurality of first yarns is different from the fiber blend of the plurality of second yarns;

wherein the fabric comprises a warp direction and a fill direction and wherein the plurality of first yarns and the plurality of second yarns are provided in both the warp and fill directions; and wherein the fabric satisfies at least one performance standard set forth in NFPA 1971 (1991).

20. The flame resistant fabric of claim 19, wherein the second fibers are long staple fibers and comprise an inherently flame resistant material.

* * * * *